US009054424B1

(12) United States Patent
Hunt et al.

(10) Patent No.: US 9,054,424 B1
(45) Date of Patent: Jun. 9, 2015

(54) USING A METAMATERIAL STRUCTURE TO MODIFY AN ELECTROMAGNETIC BEAM

(71) Applicant: The Boeing Company, Chicago, IL (US)

(72) Inventors: Jeffrey H. Hunt, Thousand Oaks, CA (US); Nicholas Koumvakalis, Thousand Oaks, CA (US)

(73) Assignee: THE BOEING COMPANY, Chicago, IL (US)

( * ) Notice: Subject to any disclaimer, the term of this patent is extended or adjusted under 35 U.S.C. 154(b) by 312 days.

(21) Appl. No.: 13/752,649

(22) Filed: Jan. 29, 2013

(51) Int. Cl.
*H01Q 19/06* (2006.01)

(52) U.S. Cl.
CPC ..... *H01Q 19/06* (2013.01)

(58) Field of Classification Search
USPC ..... 343/753, 756, 909
See application file for complete search history.

(56) References Cited

U.S. PATENT DOCUMENTS 7,538,946 B2 5/2009 Smith et al.
2010/0033389 A1* 2/2010 Yonak et al. ..... 343/755
2012/0299788 A1* 11/2012 Liu et al. ..... 343/753
2012/0327666 A1* 12/2012 Liu et al. ..... 362/326
2013/0016030 A1* 1/2013 Liu et al. ..... 343/909

FOREIGN PATENT DOCUMENTS

EP 2202545 A1 6/2010

OTHER PUBLICATIONS

Aieta et al., "Aberration-Free Ultrathin Flat Lenses and Axicons at Telecom Wavelengths Based on Plasmonic Metasurfaces," NANO Letters, vol. 12, No. 19, Aug. 2012, pp. 4932-4936.
Kildishev et al., "Transformation Optics and Metamaterials," Birck and NCN Publications, Purdue University, Jan. 2011, 13 pages.

* cited by examiner

*Primary Examiner* — Tan Ho
(74) *Attorney, Agent, or Firm* — Yee & Associates, P.C.

(57) ABSTRACT

An apparatus and method for modifying an electromagnetic beam. A metamaterial structure is positioned relative to a transmitting device such that an electromagnetic beam transmitted by the transmitting device passes through the metamaterial structure. The electromagnetic beam has a wavefront with a Gaussian intensity profile. The wavefront of the electromagnetic beam is modified as the electromagnetic beam passes through the metamaterial structure such that the Gaussian intensity profile of the wavefront is changed to a Bessel intensity profile.

20 Claims, 3 Drawing Sheets

USING A METAMATERIAL STRUCTURE TO MODIFY AN ELECTROMAGNETIC BEAM

BACKGROUND INFORMATION

1. Field

The present disclosure relates generally to electromagnetic beams and, in particular, to modifying the wavefront of an electromagnetic beam. Still more particularly, the present disclosure relates to using or modifying the index of refraction of a metamaterial structure for the purposes of modifying the wavefront of an electromagnetic beam to within selected characteristics, properties, and tolerances.

2. Background

Electromagnetic radiation is often times used in communications. Typically, the electromagnetic radiation is transmitted and received in the form of electromagnetic waves. These waves may be transmitted and/or received in the form of an electromagnetic beam. In some cases, the electromagnetic beam may be transmitted in a manner such that the beam has Gaussian properties. For example, the electromagnetic beam may have a wavefront with a Gaussian intensity profile. This type of electromagnetic beam may be referred to as a Gaussian beam.

Gaussian beams are prone to diffraction. Diffraction occurs once the waves that form an electromagnetic beam propagate and may be increased when the waves encounter an obstacle. When the waves encounter the obstacle, the waves may bend around the obstacle. The bending of the waves may alter the amplitude and/or phase of the waves. In some cases, the diffraction of a beam may result in a loss of information that is carried within the electromagnetic beam. More specifically, the diffraction may result in a loss of power of the electromagnetic beam at a target, which may, in turn result in a reduction in signal to noise ratio.

True Bessel beams, however, are non-diffractive. In other words, a true Bessel beam does not diffract as the waves that form the beam propagate through one or more media. A Bessel beam may be an electromagnetic beam having a wavefront with a Bessel intensity profile. Currently, engineering a true Bessel beam may not be possible. However, approximations of a Bessel beam may be engineered.

Currently, axicon lenses may be used to change Gaussian beams into Bessel beams. An axicon lens is a lens that has a conical surface. An axicon images a point source into a line along the optic axis, or transforms a beam into a ring. However, some currently available axicon lenses may be able only to change Gaussian beams comprised of light waves into Bessel beams. These axicon lenses may not be configured for use with radio frequency waves.

Further, the geometry of an axicon lens may prevent the axicon lens from being integrated as part of an integrated optical system. For example, the size and/or shape of the axicon lens may prevent the axicon lens from being integrated into an integrated optical system. Therefore, it would be desirable to have a method and apparatus that takes into account at least some of the issues discussed above, as well as other possible issues.

SUMMARY

In one illustrative embodiment, an apparatus comprises a transmitting device and a metamaterial structure. The transmitting device is configured to transmit an electromagnetic beam having a wavefront with a Gaussian intensity profile. The metamaterial structure is positioned relative to the transmitting device such that the electromagnetic beam passes through the metamaterial structure. The metamaterial structure is configured to modify the wavefront of the electromagnetic beam as the electromagnetic beam passes through the metamaterial structure to change the Gaussian intensity profile of the wavefront to a Bessel intensity profile.

In another illustrative embodiment, a method is provided in which a metamaterial structure is positioned relative to a transmitting device such that an electromagnetic beam transmitted by the transmitting device passes through the metamaterial structure. The electromagnetic beam has a wavefront with a Gaussian intensity profile. The wavefront of the electromagnetic beam is modified as the electromagnetic beam passes through the metamaterial structure such that the Gaussian intensity profile of the wavefront is changed to a Bessel intensity profile.

The features and functions can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and features thereof, will best be understood by reference to the following detailed description of an illustrative embodiment of the present disclosure when read in conjunction with the accompanying drawings, wherein:

DETAILED DESCRIPTION

The illustrative embodiments recognize and take into account different considerations. For example, the illustrative embodiments recognize and take into account that an axicon lens modifies a wavefront by varying the physical length that each section of the wavefront sees. This modification may cause some sections of the wavefront to move faster than other sections, which may change the Gaussian intensity profile of a wavefront to a Bessel intensity profile. However, the illustrative embodiments recognize and take into account that the shape needed for the axicon lens may not allow the axicon lens to be integrated, or physically fit within, an optical system along with the other optical elements of that optical system.

Additionally, the illustrative embodiments recognize and take into account that modern communications systems incorporate waveguides, such as, for example, fiberoptics in the optical regime, to control the propagation of electromagnetic radiation. Interfacing these waveguide systems with a shape like the shape of an axicon lens may be more difficult than desired. Further, the illustrative embodiments recognize and take into account that within the radio frequency regime, where longer wavelengths lead to larger component sizes, the physical equivalent of an axicon lens may make implementation more difficult than desired.

Consequently, the illustrative embodiments recognize and take into account that it may be desirable to have a structure that allows a wavefront to be modified to have a Bessel intensity profile. The structure may be comprised of metamaterials that allow the structure to take on various shapes and/or sizes that may allow the structure to be integrated within an integrated optical system or some other type of integrated communications system.

Figure 1:
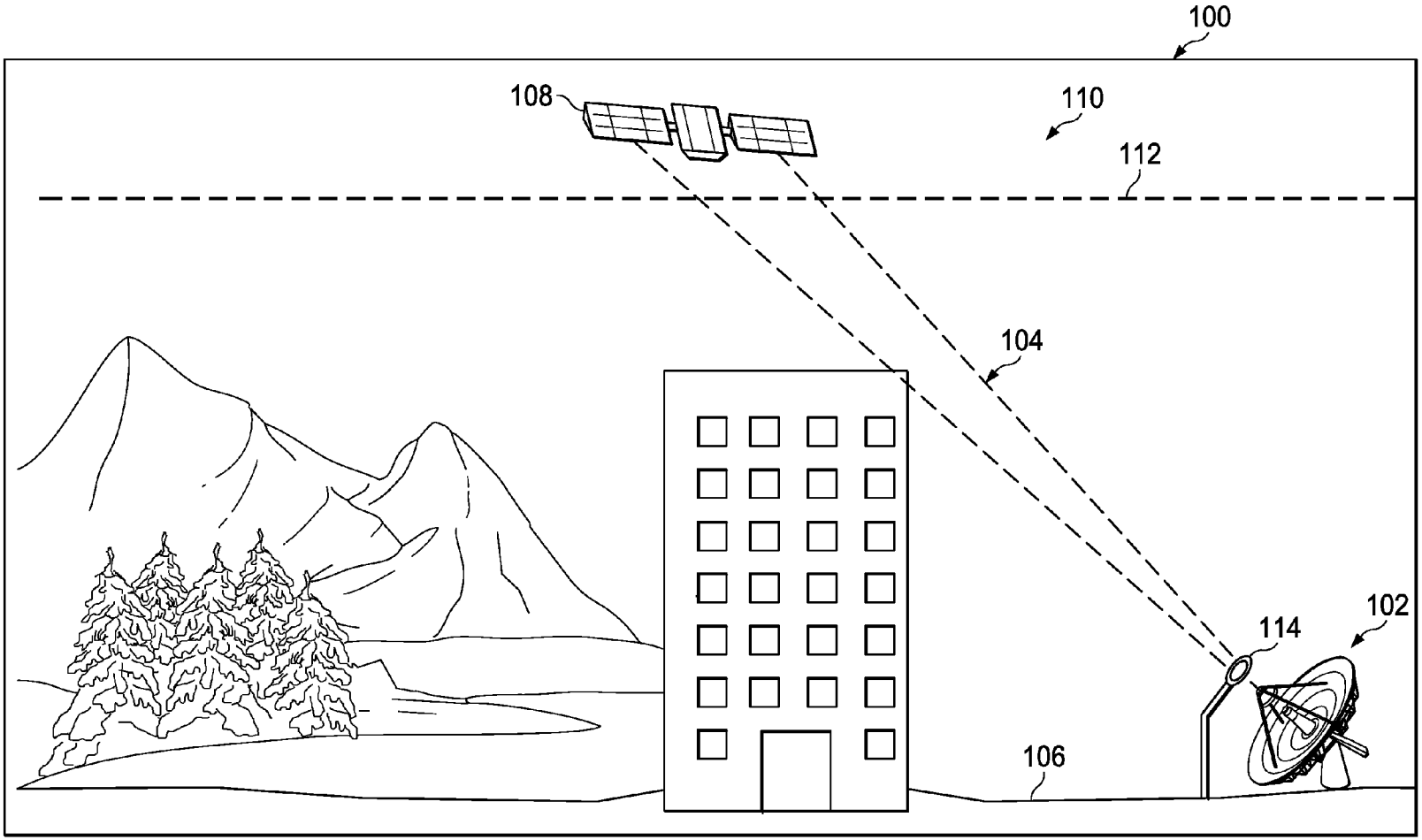
FIG. 1 is an illustration of a communications environment in accordance with an illustrative embodiment.

Referring now to the figures and, in particular, with reference to FIG. 1, an illustration of a communications environment is depicted in accordance with an illustrative embodiment. In this illustrative example, communications environment 100 includes ground communications system 102. Ground communications system 102 is configured to transmit radio frequency (RF) beam 104. In particular, radio frequency beam 104 is transmitted from ground 106 towards satellite communications system 108 in space 110.

In this illustrative example, radio frequency beam 104 transmitted by ground communications system 102 has a Gaussian intensity profile. As used herein, the "intensity profile" of a beam is the intensity distribution of that beam substantially perpendicular to the axis along which the beam propagates. This intensity distribution may also be referred to as the transverse intensity distribution of the beam. With a Gaussian intensity profile, the transverse intensity distribution of radio frequency beam 104 may be approximated by a Gaussian function.

With a Gaussian intensity profile, radio frequency beam 104 diffracts as radio frequency beam 104 passes through air 112 and, in some cases, through space 110. Metamaterial structure 114 may be used to reduce diffraction of radio frequency beam 104. As depicted, metamaterial structure 114 is positioned relative to ground communications system 102. Metamaterial structure 114 may be any structure comprised of one or more metamaterials.

In this illustrative example, metamaterial structure 114 may be used to modify radio frequency beam 104 such that the Gaussian intensity profile of the wavefront of radio frequency beam 104 is changed into a Bessel intensity profile. In other words, radio frequency beam 104 may be modified during propagation through metamaterial structure 114 such that the transverse intensity distribution of the wavefront of radio frequency beam 104 may be approximated using one or more Bessel functions. Bessel functions are canonical solutions to the Bessel differential equation.

Once radio frequency beam 104 has been modified, diffraction of radio frequency beam 104 as radio frequency beam 104 passes through air 112 and space 110 may be reduced to near-zero. In other words, the diffraction of radio frequency beam 104 may be reduced to within some selected range of zero.

Figure 2:
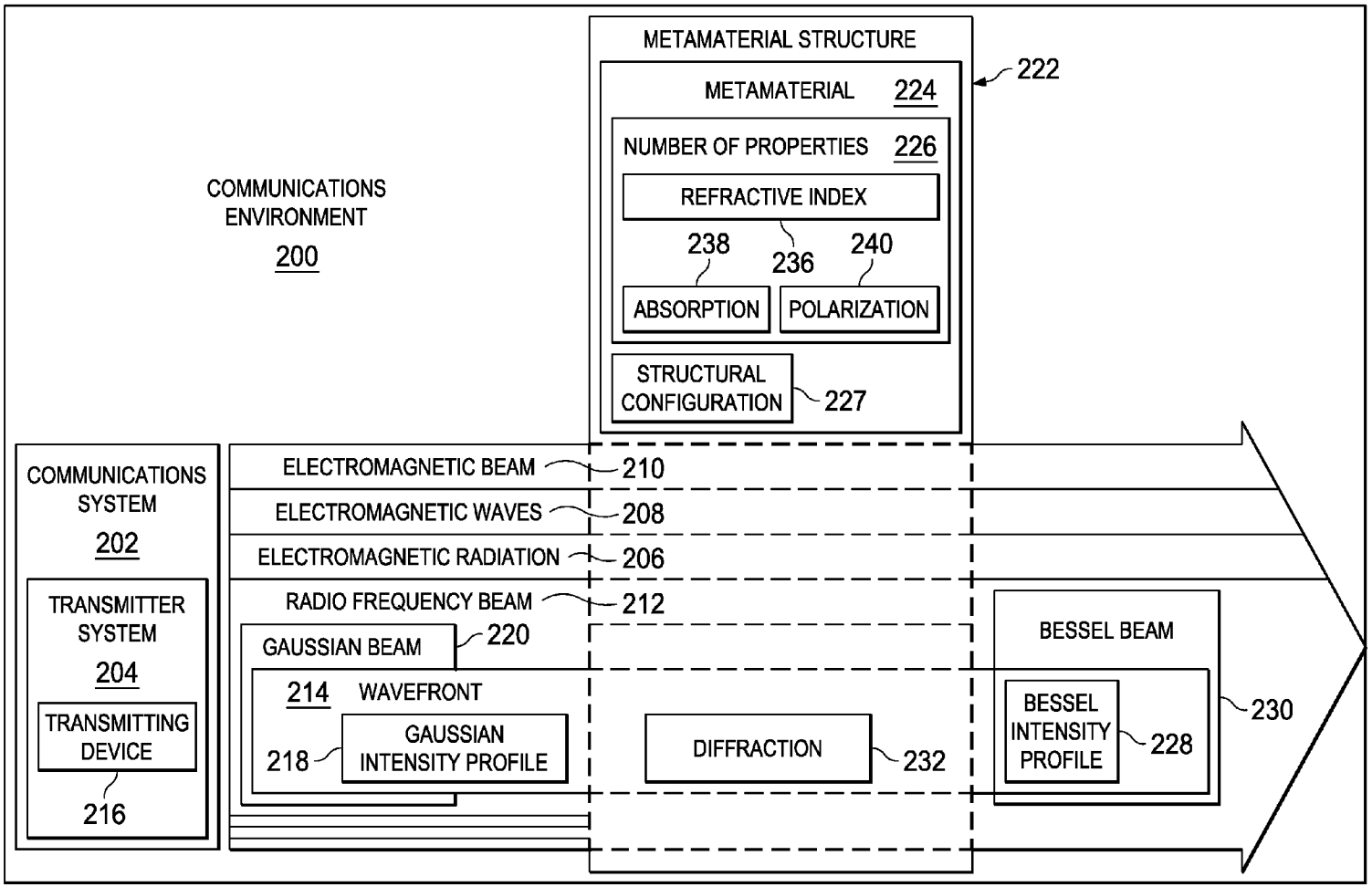
FIG. 2 is an illustration of a communications environment in the form of a block diagram in accordance with an illustrative embodiment.

With reference now to FIG. 2, an illustration of a communications environment is depicted in the form of a block diagram in accordance with an illustrative embodiment. Communications environment 100 in FIG. 1 may be an example one implementation for communications environment 200 in FIG. 2.

As depicted, communications environment 200 includes communications system 202. Ground communications system 102 in FIG. 1 is an example of one implementation for communications system 202. In this illustrative example, communications system 202 includes transmitter system 204 configured to transmit electromagnetic radiation 206 in the form of electromagnetic waves 208. In particular, transmitter system 204 may be configured to transmit electromagnetic waves 208 in the form of electromagnetic beam 210.

In one illustrative example, electromagnetic beam 210 may take the form of radio frequency (RF) beam 212 comprised of radio frequency (RF) waves. Radio frequency waves may be electromagnetic waves having a wavelength between about 3 millimeters and about 30 micrometers, or microns. Of course, in other illustrative examples, electromagnetic beam 210 may take the form of a light beam such as, for example, a visible light beam, an infrared light beam, an ultraviolet light beam, or some other type of electromagnetic beam.

As depicted, electromagnetic beam 210 has wavefront 214. In these illustrative examples, transmitting device 216 within transmitter system 204 is configured to transmit electromagnetic beam 210 in a manner such that wavefront 214 has Gaussian intensity profile 218. With wavefront 214 having Gaussian intensity profile 218, electromagnetic beam 210 may diffract during propagation of electromagnetic beam 210.

Electromagnetic beam 210 having wavefront 214 with Gaussian intensity profile 218 may be referred to as Gaussian beam 220 in these illustrative examples. In this manner, transmitting device 216 may transmit Gaussian beam 220. In one illustrative example, transmitting device 216 takes the form of an antenna. In some cases, transmitting device 216 may take the form of a phased array antenna.

Metamaterial structure 222 may be used to modify wavefront 214 of electromagnetic beam 210. In these illustrative examples, metamaterial structure 222 is comprised of metamaterial 224. Metamaterial 224 is an artificial material that has been engineered to have properties that may not be found in nature. Metamaterial 224 may be, for example, an assembly of multiple individual elements created from conventional microscopic materials, such as, but not limited to, metals or plastics. These materials may be arranged in periodic patterns to form metamaterial 224.

Metamaterial 224 may have number of properties 226 that affect electromagnetic waves 208 that form electromagnetic beam 210. In this manner, metamaterial 224 may be referred to as an electromagnetic metamaterial in these examples. As used herein, a "number of" items may be one or more items. In this manner, number of properties 226 may be one or more properties that allow metamaterial 224 to interact with and control electromagnetic waves.

Number of properties 226 of metamaterial 224 may be determined by the exactingly-designed structural configuration 227 of metamaterial 224. Structural configuration 227 of metamaterial 224 may comprise the shape, geometry, size, orientation, and/or arrangement of the structural elements used to form metamaterial 224.

Structural configuration 227 of metamaterial 224 determines the manner in which electromagnetic waves 208 that propagate through metamaterial structure 222 are affected. In these illustrative examples, the structural elements that form structural configuration 227 of metamaterial 224 may be engineered such that the sizes of these elements are less than the wavelengths of electromagnetic waves 208 that are to propagate through metamaterial structure 222.

As depicted, metamaterial structure 222 is used to change wavefront 214 of electromagnetic beam 210 such that wavefront 214 has Bessel intensity profile 228. Electromagnetic beam 210 having wavefront 214 with Bessel intensity profile 228 may be referred to as Bessel beam 230. In these illustrative examples, Bessel beam 230 may be a near-Bessel beam or, in other words, an approximation of a Bessel beam.

In this manner, metamaterial structure 222 may be used to change Gaussian beam 220 into Bessel beam 230. Changing the wavefront 214 of electromagnetic beam 210 from having Gaussian intensity profile 218 to Bessel intensity profile 228 reduces diffraction 232 of electromagnetic beam 210. In particular, electromagnetic beam 210 having wavefront with Bessel intensity profile 228 may have near-zero diffraction, or substantially zero diffraction within selected tolerances.

Structural configuration 227 may be configured such that each of number of properties 226 is within a selected range. In these illustrative examples, number of properties 226 of metamaterial 224 may be selected such that Gaussian beam 220 may be changed into Bessel beam 230. Number of properties 226 may include at least one of refractive index 236, absorption 238, and polarization 240. Refractive index 236 is a measure of how electromagnetic waves 208 propagate through metamaterial 224.

Refractive index 236 of metamaterial 224 may determine the effect of metamaterial 224 on the speed of electromagnetic waves 208. Absorption 238 may be a measure of the amount of electromagnetic radiation 206 within electromagnetic beam 210 that will be absorbed by metamaterial 224 as electromagnetic beam 210 propagates through metamaterial structure 222.

Polarization 240 may be the effect of metamaterial 224 on the various polarizations of electromagnetic waves 208 that form electromagnetic beam 210. For example, electromagnetic waves 208 may be configured to oscillate in more than one direction with respect to the axis along which electromagnetic waves 208 propagate. Each one of these directions may be a polarization. As electromagnetic beam 210 passes through metamaterial structure 222, one or more of these polarizations may be affected by metamaterial 224, depending on structural configuration 227 of metamaterial 224.

In these illustrative examples, electromagnetic beam 210 having wavefront 214 with Bessel intensity profile 228 may be less prone to information loss during the propagation of electromagnetic beam 210. Further, in some cases, electromagnetic beam 210 having wavefront 214 with Bessel intensity profile 228 may be considered at least partially self-healing. For example, electromagnetic beam 210 may be capable of returning to an approximation of the initial state of electromagnetic beam 210. The difference between the approximation of the initial state and the actual initial state may be determined by the difference between electromagnetic beam 210 and an actual, or true, Bessel beam.

Metamaterial structure 222 may be formed having any of a number of shapes. In one illustrative example, metamaterial structure 222 may take the form of a cuboid. In another illustrative example, metamaterial structure 222 may take the form of a curved lens having a curved shape. In some cases, metamaterial structure 222 may have a shape selected from one of a cylindrical shape, a disc shape, a rhomboid shape, a toroidal shape, a spherical shape, and/or some other type of shape.

Depending on the implementation, metamaterial structure 222 may have any shape and/or size that may allow metamaterial structure 222 to be integrated within an integrated communications system. In other words, metamaterial structure 222 may have a shape and/or size that allows metamaterial structure 222 to physically fit within a housing for an integrated communications system along with all of the other communications elements located within the housing.

The illustration of communications environment 200 in FIG. 2 is not meant to imply physical or architectural limitations to the manner in which an illustrative embodiment may be implemented. Other components in addition to or in place of the ones illustrated may be used. Some components may be optional. Also, the blocks are presented to illustrate some functional components. One or more of these blocks may be combined, divided, or combined and divided into different blocks when implemented in an illustrative embodiment.

Figure 3:
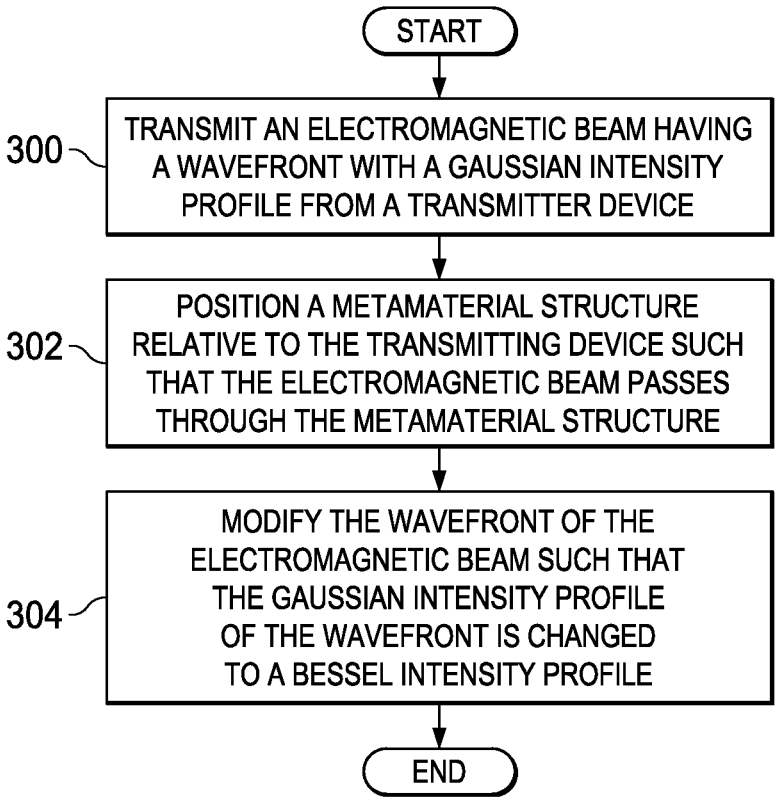
FIG. 3 is an illustration of a process for modifying an electromagnetic beam using a metamaterial structure in the form of a flowchart in accordance with an illustrative embodiment.

With reference now to FIG. 3, an illustration of a process for modifying an electromagnetic beam using a metamaterial structure is depicted in the form of a flowchart in accordance with an illustrative embodiment. The process illustrated in FIG. 3 may be implemented within communications environment 100 in FIG. 1 and communications environment 200 in FIG. 2.

An electromagnetic beam comprised of electromagnetic waves having a wavefront with a Gaussian intensity profile is transmitted from a transmitting device (operation 300). A metamaterial structure is positioned relative to the transmitting device such that the electromagnetic beam passes through the metamaterial structure (operation 302). The metamaterial structure may be, for example, metamaterial structure 114 in FIG. 1 or metamaterial structure 222 in FIG. 2.

Thereafter, the wavefront of the electromagnetic beam is modified such that the Gaussian intensity profile of the wavefront is changed to a Bessel intensity profile (operation 304), with the process terminating thereafter. In this manner, the electromagnetic beam that exits the metamaterial structure may have reduced diffraction as compared to the electromagnetic beam that entered the metamaterial structure.

The flowchart and block diagram in the different depicted embodiments illustrate the architecture, functionality, and operation of some possible implementations of apparatuses and methods in accordance with an illustrative embodiment. In this regard, each block in the flowchart or block diagram may represent a module, a segment, a function, and/or a portion of an operation or step.

In some alternative implementations of an illustrative embodiment, the function or functions noted in the blocks may occur out of the order noted in the figures. For example, in some cases, two blocks shown in succession may be executed substantially concurrently, or the blocks may sometimes be performed in the reverse order, depending upon the functionality involved. Also, other blocks may be added in addition to the illustrated blocks in the flowchart or block diagram.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different features as compared to other desirable embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An apparatus comprising:

a transmitting device configured to transmit an electromagnetic beam having a wavefront with a Gaussian intensity profile; and a metamaterial structure positioned relative to the transmitting device such that the electromagnetic beam passes through the metamaterial structure and configured to modify the wavefront of the electromagnetic beam as the electromagnetic beam passes through the metamaterial structure to change the Gaussian intensity profile of the wavefront to a Bessel intensity profile.

2. The apparatus of claim 1, wherein the electromagnetic beam is comprised of electromagnetic waves having a wavelength between about 3 millimeters and about 30 micrometers.

3. The apparatus of claim 1, wherein the electromagnetic beam that exits the metamaterial structure having the wavefront with the Bessel intensity profile is less diffractive than the electromagnetic beam having the wavefront with the Gaussian intensity profile.

4. The apparatus of claim 1, wherein the metamaterial structure is comprised of a metamaterial having a structural configuration configured such that the metamaterial has a number of properties in which each of the number of properties is within a selected range.

5. The apparatus of claim 4, wherein the number of properties includes at least one of a refractive index, absorption, and polarization.

6. The apparatus of claim 1, wherein the transmitting device is part of a ground communications system.

7. The apparatus of claim 1, wherein the transmitting device is part of a satellite communications system.

8. The apparatus of claim 1, wherein changing the Gaussian intensity profile of the wavefront to the Bessel intensity profile reduces diffraction of the electromagnetic beam to substantially zero within selected tolerances.

9. The apparatus of claim 1, wherein the metamaterial structure is integrated within an integrated communications system.

10. The apparatus of claim 9, wherein the metamaterial structure has a shape and size that allows the metamaterial structure to be integrated within the integrated communications system.

11. The apparatus of claim 1, wherein the metamaterial structure is a curved lens.

12. The apparatus of claim 1, wherein the metamaterial structure has a shape selected from one of a cylindrical shape, a spherical shape, a disc shape, a rhomboid shape, and a toroidal shape.

13. A method comprising:

positioning a metamaterial structure relative to a transmitting device such that an electromagnetic beam transmitted by the transmitting device passes through the metamaterial structure, wherein the electromagnetic beam has a wavefront with a Gaussian intensity profile; and modifying the wavefront of the electromagnetic beam as the electromagnetic beam passes through the metamaterial structure such that the Gaussian intensity profile of the wavefront is changed to a Bessel intensity profile.

14. The method of claim 13, wherein modifying the wavefront comprises:

modifying the wavefront of the electromagnetic beam as the electromagnetic beam passes through the metamaterial structure such that the electromagnetic beam that exits the metamaterial structure having the wavefront with the Bessel intensity profile is less diffractive than the electromagnetic beam having the wavefront with the Gaussian intensity profile.

15. The method of claim 13 further comprising:

forming the metamaterial structure from a metamaterial having a structural configuration configured such that the metamaterial has a number of properties in which each of the number of properties is within a selected range.

16. The method of claim 15, wherein forming the metamaterial structure comprises:

forming the metamaterial structure from the metamaterial having the structural configuration configured such that the metamaterial has each of at least one of a refractive index, absorption, and polarization within a selected range.

17. The method of claim 13 further comprising:

transmitting the electromagnetic beam from the transmitting device, wherein the electromagnetic beam is comprised of electromagnetic waves having a wavelength between about 3 millimeters and about 30 micrometers.

18. The method of claim 17, wherein transmitting the electromagnetic beam comprises:

transmitting the electromagnetic beam from the transmitting device, wherein the transmitting device is part of a ground communications system.

19. The method of claim 13, wherein modifying the wavefront comprises:

changing the Gaussian intensity profile of the wavefront to the Bessel intensity profile such that diffraction of the electromagnetic beam is reduced to substantially zero within selected tolerances.

20. The method of claim 13, wherein positioning the metamaterial structure relative to the transmitting device comprises:

positioning the metamaterial structure relative to the transmitting device within an integrated communications system.

* * * * *